US010542780B2

(12) United States Patent
Chung

(10) Patent No.: US 10,542,780 B2
(45) Date of Patent: Jan. 28, 2020

(54) VAPOR GENERATING ELECTRONIC CIGARETTE

(71) Applicant: Esquire Properties Trading Inc., Walnut, CA (US)

(72) Inventor: Henry Chung, Walnut, CA (US)

( * ) Notice: Subject to any disclaimer, the term of this patent is extended or adjusted under 35 U.S.C. 154(b) by 175 days.

(21) Appl. No.: 15/829,222

(22) Filed: Dec. 1, 2017

(65) Prior Publication Data

US 2019/0166907 A1 Jun. 6, 2019

(51) Int. Cl.

| | |
|---|---|
| ***A24F 13/00*** | (2006.01) |
| ***A24F 47/00*** | (2006.01) |
| ***H05B 3/44*** | (2006.01) |

(52) U.S. Cl.

CPC ..... *A24F 47/008* (2013.01); *H05B 3/44* (2013.01); *H05B 2203/021* (2013.01)

(58) Field of Classification Search

CPC ..... A24F 47/00
USPC ..... 131/328, 329
See application file for complete search history.

(56) References Cited

U.S. PATENT DOCUMENTS

2016/0366725 A1* 12/2016 Tucker ..... H05B 3/06

* cited by examiner

*Primary Examiner* — Phuong K Dinh
(74) *Attorney, Agent, or Firm* — Clement Cheng

(57) ABSTRACT

A vapor generator has a mouthpiece; an upper adapter receiving the mouthpiece; a central post connecting to the upper adapter; a fluid reservoir, wherein the central post passes through the fluid reservoir; central post openings formed on the central post; a heating element configured to generate heat for vaporizing vapor fluid; and a heating element base configured to retain the heating element. The central post openings receive vapor fluid. A first polarity base body is electrically conductive and has a first polarity base air intake. A duckbill valve is disposed within the first polarity base body through a base opening. A second polarity base is electrically conductive and insulated from the first polarity base body by an insulating sleeve.

18 Claims, 4 Drawing Sheets

VAPOR GENERATING ELECTRONIC CIGARETTE

FIELD OF THE INVENTION

The present invention is in the field of vapor generators.

DISCUSSION OF RELATED ART

Vapor generators have been used for smoking cessation and smoking substitution products. Vapor generators generate a stream of vapor from electrically heating a liquid or gel.

SUMMARY OF THE INVENTION

A vapor generator has a mouthpiece; an upper adapter receiving the mouthpiece; a central post connecting to the upper adapter; a fluid reservoir, wherein the central post passes through the fluid reservoir; central post openings formed on the central post; a heating element configured to generate heat for vaporizing vapor fluid; and a heating element base configured to retain the heating element. The central post openings receive vapor fluid. A first polarity base body is electrically conductive and has a first polarity base air intake. A duckbill valve is disposed within the first polarity base body through a base opening. A second polarity base is electrically conductive and insulated from the first polarity base body by an insulating sleeve.

The second polarity base has a second polarity base air intake. The second polarity base air intake and the first polarity base air intake allow air to be received to the duckbill valve. The vapor generator optionally includes an upper gasket and a lower gasket to provide a seal to the reservoir tank when the reservoir tank is formed as a tube of glass. The reservoir tank has a tank base edge sealed by the lower gasket.

The central post has a central post O-ring and a central post upper thread. The central post upper thread secures to the upper adapter, and the central post O-ring seals to the upper adapter. The heating element base has a pair of heating element base prongs extending above a heating element base flange. The central post has a central post conduit, and the central post conduit has a central post flange that flares to a larger diameter at a lower end of the central post conduit. The central post has a central post O-ring retainer formed as a circular extension. The heating element base has a heating element base slot, and the heating element base slot is aligned to the central post openings for receiving fluid from the fluid reservoir.

The positive extension fits inside the insulator sidewall. The positive extension and the insulator sidewall connect to the heating element base. The positive extension is electrically conductive. The fluid reservoir has a fluid reservoir top and a fluid reservoir bottom. The fluid reservoir bottom further includes a fluid reservoir bottom opening. The fluid reservoir bottom is configured for filling and dispensing, so that the fluid reservoir bottom opening provides a constant pressure for the filling chamber. The vapor generator has a twist opening so that it can be opened with a single twist to disconnect the fluid reservoir from the heating base. When twisted open, the vapor generator may have a single fluid reservoir bottom opening to better control air pressure.

Figure 1:
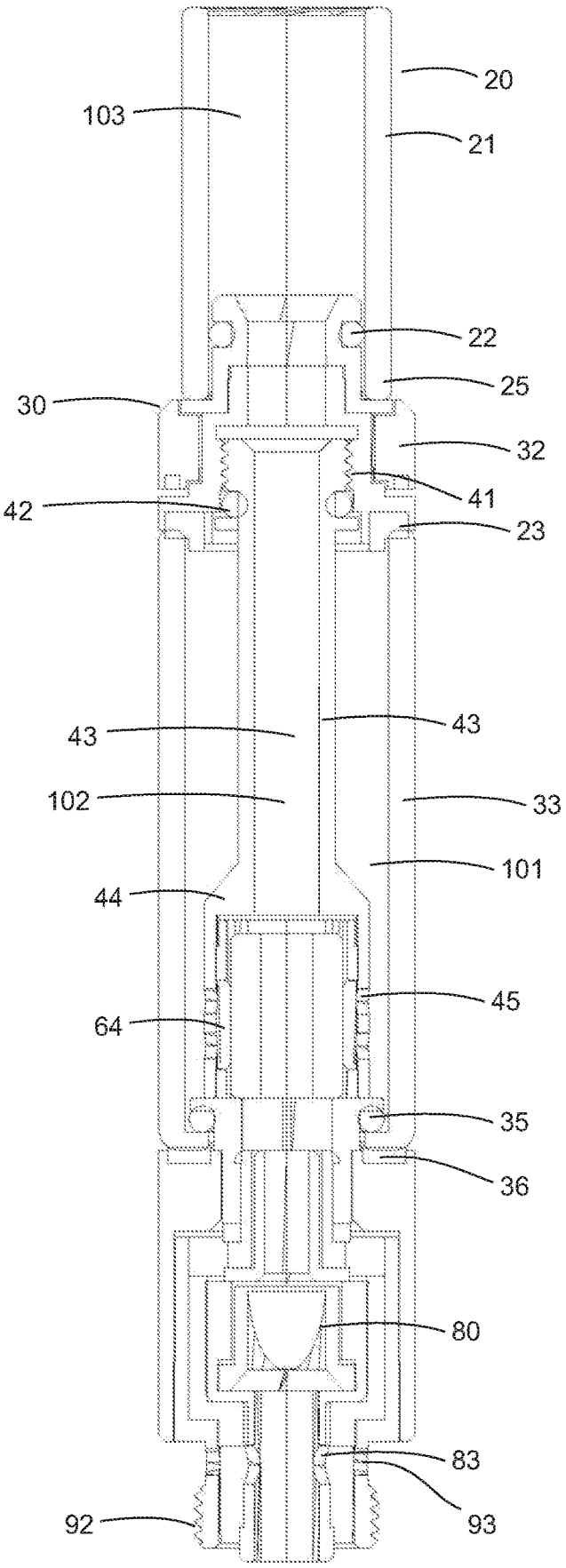
FIG. 1 is a cross-section of the present invention.
Figure 2:
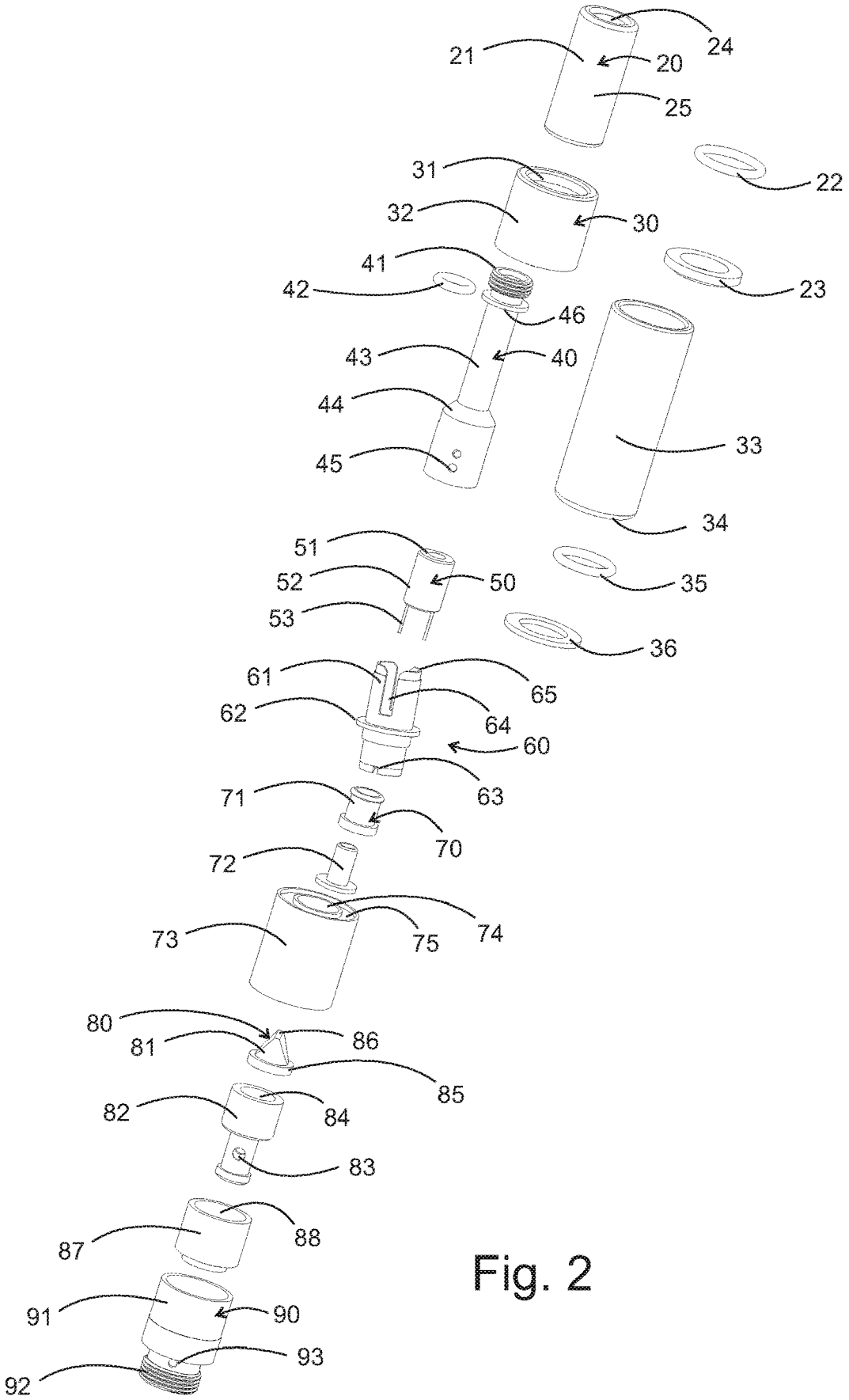
FIG. 2 is an exploded view of the present invention.

The following call out list of elements can be a useful guide and referencing elements of the drawings.

20 mouthpiece
21 mouthpiece sidewall
22 mouthpiece O-ring
23 upper gasket
24 mouthpiece tip
25 mouthpiece base
30 upper adapter
31 upper adapter gasket groove
32 upper adapter sidewall
33 reservoir tank
34 tank base edge
35 tank O-ring
36 lower gasket
40 central post
41 central post upper thread
42 central post O-ring
43 central post conduit
44 central post flange
45 central post openings
46 central post O-ring retainer
50 heating element
51 heating element tip
52 heating element body
53 heating element conductive leads
60 heating element base
61 heating element base retainer socket
62 heating element base flange
63 heating element base lower end
64 heating element base slot
65 heating element base prong
70 insulator
71 insulator sidewall
72 positive extension
73 base
74 base opening
75 lower gasket groove
76 positive extension flange
80 duckbill valve
81 valve sidewall
86 valve opening
85 valve lower retaining ring
82 positive base body
83 positive base air intake
84 positive base opening
89 positive base lower body
87 insulating sleeve
88 insulating sleeve opening
90 negative base
91 negative base conductive sidewall
92 negative base threaded terminal
93 negative base air intake
101 fluid reservoir
102 central airflow conduit
103 mouthpiece conduit
111 connector
112 spring
113 metal tube
114 chamber cover
115 chamber cover O-ring

116 heating element base
117 silicone ring
118 positive connector

DETAILED DESCRIPTION OF THE PREFERRED EMBODIMENT

The present invention includes a mouthpiece 20 having a mouthpiece tip 24 that a user aspirates from. The mouthpiece 20 has a mouthpiece sidewall 21 in a generally cylindrical shape and a mouthpiece base 25 in a circular shape. The mouthpiece O-ring 22 seals the mouthpiece base 25 to the upper adapter 30. The mouthpiece base fits to the upper adapter 30. The upper adapter 30 has a cylindrical sidewall 32. The upper gasket groove 31 is formed on the upper adapter 30. The upper gasket groove 31 is configured to receive an upper gasket 23. The upper gasket 23 seals to the fluid tank 33. The fluid tank 33 is configured to be filled with a gel or liquid which are both fluids. The mouthpiece O-ring 22 seals the mouthpiece to the upper adapter 30. The fluid tank 33 has a tank base edge 34 that abuts against and is sealed to a lower gasket 36. The lower gasket 36 can be formed of an elastomer such as a rubber or silicone.

The central post 40 is positioned inside the fluid tank 33. The central post 40 preferably includes a central post upper thread 41 for threadedly connecting the upper adapter 32 the central post 40. The central post 40 also has a central post conduit 43 extending downwardly to a central post flange 44 where the central post has a larger diameter. Central post openings 45 receive liquid from the liquid tank 33. The central post openings 45 are aligned to the heating element base slot 64 so that liquid can pass from the tank 33 to the central post openings 45 and then to the heating element base slot 64. After passing through the heating element base slot 64, the heating element 50 heats the liquid to a vapor so as to generate a stream of vapor.

The central post 40 has a central post O-ring 42 that seals against the upper adapter 30. The central post flange retains the central post O-ring 42 in a groove which is the central post O-ring groove. The seal between the central post O-ring 42 and the upper adapter 30 is probably an airtight seal. The central post O-ring 42 can be made of an elastomer such as silicone. The central post O-ring 42 can be retained by a central post O-ring retainer 46.

The heating element 50 has a heating element tip 51 that emits a stream of heated air or emits heat. The heating element body 52 has room for holding a coil of wire such as a heating element coil wire inside the heating element body 52. The heating element body 52 is therefore heated by electrical resistance. The heating element conductive leads 53 preferably include a positive and negative conductive lead that extended downwardly from the heating element body 52. The heating element body 52 is generally cylindrical and sized to be received in a heating element base 60.

The heating element base 60 has a heating element base retainer socket 61 that is sized for receiving the heating element body 52 of the heating element 50. The heating element base 60 has a heating element base slot 64. The heating element base slot 64 is between and defines a pair of heating element base prongs 65. The heating element base prongs 65 together define the heating element base retainer socket 61. The heating element base 60 also has a heating element base flange that holds the heating element base 60. The heating element base lower end 63 has a notch formed in its underside that aligns to the heating element base slot 64.

Preferably, an insulator 70 fits into the heating element base lower end 63. The insulator 60 is preferably a silicone tube having an upper annular protrusion and a lower annular protrusion. The positive extension 72 fits inside the insulator 60 and conducts electricity from the positive base to the heating element leads 53. The positive base has a positive base upper body 82 and a positive base lower body 89. The positive base opening 84 is formed on an upper surface of the positive base. The positive base also has a positive base air intake 83. The positive base air intake 83 receives air and is aligned to an air intake 93 on the negative base.

A duckbill valve 80 has a duckbill valve sidewall 81 that is flexible and allows air to be selectively passed through a valve opening 86. The valve opening 86 is formed on an opposite end of the duckbill valve 80 than the valve lower retaining ring 85. The valve lower retaining ring 85 fits into the positive base opening 84 and deforms in an elastomeric manner so that it is lodged within the positive base opening 84. The valve opening 86 is then approximately flush with the positive base opening 84. The duckbill valve 80 is preferably made of an elastomeric material such as silicone. The positive base is insulated from the negative base 90. The negative base 90 has a negative base air intake 93 and a negative base threaded terminal 92. The negative base threaded terminal 92 threadedly connects to a battery module. The battery module can have the same diameter as the negative base conductive sidewall 91. The battery module has a battery module negative terminal that is electrically connected to the negative base conductive sidewall 91 when the negative base threaded terminal 92 is in contact to the battery module negative terminal. Similarly, the positive base lower body 89 is in contact to the battery module positive terminal when the negative base threaded terminal 92 is mechanically secured to the battery module.

The insulating sleeve 87 has an insulating sleeve opening 88 which receives the positive base upper body 82. The insulating sleeve 87 has an insulating sleeve sidewall that is sized to fit within the negative base opening. The positive base of her body 82 is sized to fit within the insulating sleeve opening 88. Therefore, the positive base and the negative base and the insulating sleeve insulating the positive base from the negative base are all coaxial to each other.

The negative base has a negative base air intake 93 that feeds to the positive base air intake 83. Then, air passes through the duckbill valve 80 and that through the base 73. The base 73 has a lower gasket groove 75 for receiving the lower gasket 36 that seals the tank base and should 34. The lower gasket groove circumscribes a base opening 74. The base opening 74 receives the positive extension flange 76 because the positive extension flange 76 has a smaller diameter than the diameter of the base opening 74.

Additionally, the fluid reservoir 101 can hold the fluid such as a gel or liquid. The liquid can be a water base or oil base liquid. A wick pulls the liquid from the fluid reservoir 101 of the tank 33 into the vaporizing chamber formed immediately above the heating element tip 51. The resulting vapor stream passes through the central airflow conduit 102 inside the central post conduit 43. Then, the vapor stream passes through the mouthpiece conduit 103 located within the mouthpiece 20 before being aspirated by a user.

Figure 3:
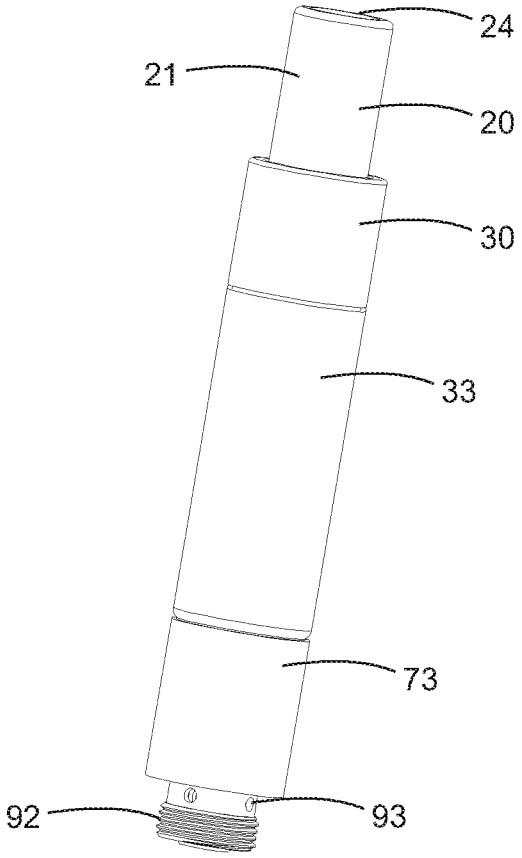
FIG. 3 is an assembled view of the present invention.
Figure 4:
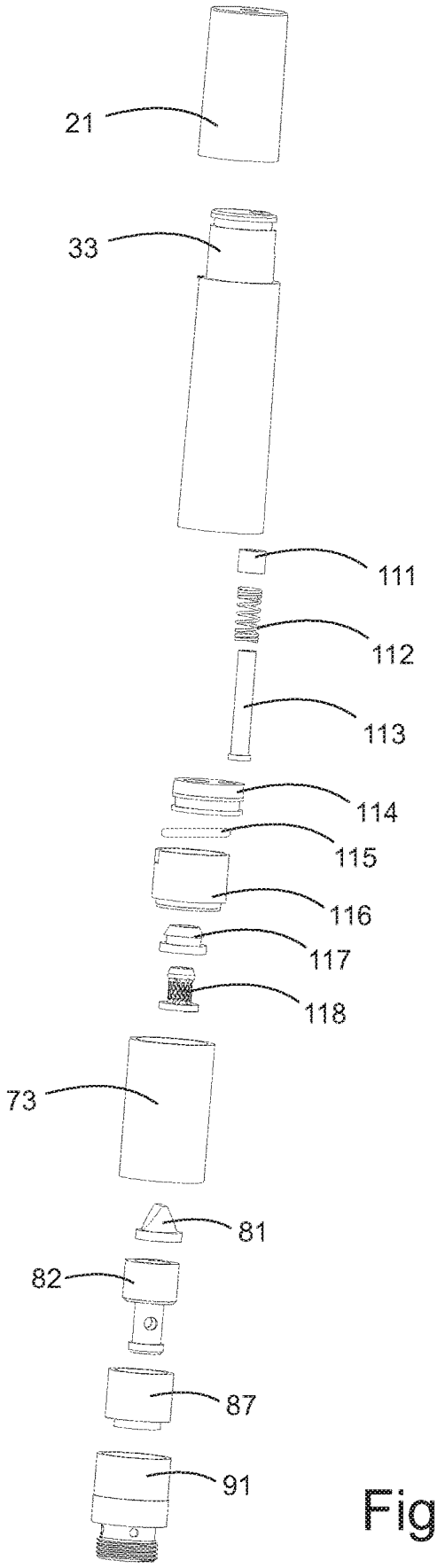
FIG. 4 is an exploded view of the present invention showing the optional metal tube valve spring biased against the chamber cover.

As seen in FIG. 3, the present invention is assembled into a compact unit. The polarity of the negative and positive base can be reversed. In either case, the positive base can be the first polarity base and the negative base can be the second polarity base. As seen in FIG. 4, which is an exploded view of an optional additional mechanism. The present invention can have an optional additional mechanism with a connector 111 connecting to a metal tube 113. A spring 112 can fit over the metal tube 113. A chamber cover 114 can have a chamber cover O-ring 115. The chamber cover 114 can fit over the heating element base 116 when the chamber cover O-ring 115 seals the chamber cover 114 to the heating element base 116. A silicone ring 117 can be an insulator between the positive connector 118 and the heating element base 116. The silicone ring 117 can fit into the heating element base 116 and the positive connector 118 can fit into the silicone ring 117.

The invention claimed is:

1. A vapor generating electronic cigarette comprising:

a. a mouthpiece;

b. an upper adapter receiving the mouthpiece;

c. a central post connecting to the upper adapter;

d. a fluid reservoir, wherein the central post passes through the fluid reservoir;

e. central post openings formed on the central post, wherein the central post openings receive vapor fluid;

f. a heating element configured to generate heat for vaporizing vapor fluid;

g. a heating element base configured to retain the heating element;

h. a first polarity base, wherein the first polarity base is electrically conductive that is either a positive base or a negative base, wherein the first polarity base has a first polarity base air intake that is either a positive base air intake or a negative base air intake;

i. a duckbill valve disposed within the first polarity base body through a base opening; wherein the duckbill valve has a duckbill valve sidewall that is flexible and allows air to be selectively passed through a duckbill valve opening, wherein the duckbill valve opening is formed on an end of the duckbill valve opposite a valve lower retaining ring, wherein the valve lower retaining ring fits to the base opening and deforms in an elastomeric manner so that it is lodged within the base opening; and j. a second polarity base, wherein the second polarity base is electrically conductive and insulated from the first polarity base body by an insulating sleeve, wherein the second polarity base is either a positive base or a negative base of opposite orientation to the first polarity base, wherein the second polarity base has a second polarity base air intake, that could be a positive base air intake or a negative base air intake, wherein the second polarity base air intake and the first polarity base air intake allow air to be received to the duckbill valve.

2. The vapor generating electronic cigarette of claim 1, further including an upper gasket and a lower gasket to provide a seal to the reservoir tank, wherein the reservoir tank is formed as a tube of glass, wherein the reservoir tank has a tank base edge sealed by the lower gasket.

3. The vapor generating electronic cigarette of claim 1, wherein the central post has a central post O-ring and a central post upper thread, wherein the central post upper thread secures to the upper adapter, wherein the central post O-ring seals to the upper adapter.

4. The vapor generating electronic cigarette of claim 1, wherein the heating element base has a pair of heating element base prongs extending above a heating element base flange.

5. The vapor generating electronic cigarette of claim 1, wherein the central post has a central post conduit, wherein the central post conduit has a central post flange that flares to a larger diameter at a lower end of the central post conduit.

6. The vapor generating electronic cigarette of claim 1, wherein the central post has a central post O-ring retainer formed as a circular extension.

7. The vapor generating electronic cigarette of claim 1, wherein the heating element base has a heating element base slot, wherein the heating element base slot is aligned to the central post openings for receiving fluid from the fluid reservoir.

8. The vapor generating electronic cigarette of claim 1, further including a positive extension fitting inside an insulator sidewall, wherein the positive extension and the insulator sidewall connect to the heating element base, wherein the positive extension is electrically conductive.

9. The vapor generating electronic cigarette of claim 1, wherein the fluid reservoir has a fluid reservoir top and a fluid reservoir bottom, wherein the fluid reservoir bottom further includes a fluid reservoir bottom opening, wherein the fluid reservoir bottom opening is configured for filling and dispensing, whereby the fluid reservoir bottom opening provides a constant pressure for the filling chamber; and wherein the fluid reservoir has a twist opening.

10. The vapor generating electronic cigarette of claim 9, further including an upper gasket and a lower gasket to provide a seal to the reservoir tank, wherein the reservoir tank is formed as a tube of glass, wherein the reservoir tank has a tank base edge sealed by the lower gasket.

11. The vapor generating electronic cigarette of claim 9, wherein the central post has a central post O-ring and a central post upper thread, wherein the central post upper thread secures to the upper adapter, wherein the central post O-ring seals to the upper adapter.

12. The vapor generating electronic cigarette of claim 9, wherein the heating element base has a pair of heating element base prongs extending above a heating element base flange.

13. The vapor generating electronic cigarette of claim 9, wherein the central post has a central post conduit, wherein the central post conduit has a central post flange that flares to a larger diameter at a lower end of the central post conduit.

14. The vapor generating electronic cigarette of claim 9, wherein the central post has a central post O-ring retainer formed as a circular extension.

15. The vapor generating electronic cigarette of claim 9, wherein the heating element base has a heating element base slot, wherein the heating element base slot is aligned to the central post openings for receiving fluid from the fluid reservoir.

16. The vapor generating electronic cigarette of claim 9, further including a positive extension fitting inside an insulator sidewall, wherein the positive extension and the insulator sidewall connect to the heating element base, wherein the positive extension is electrically conductive.

17. A vapor generating electronic cigarette comprising:

a. a mouthpiece;

b. a resistance heater;

c. a vaporizing chamber;

d. a fluid reservoir;

e. wherein the fluid reservoir has a fluid reservoir top and a fluid reservoir bottom, wherein the fluid reservoir bottom further includes a fluid reservoir bottom opening, wherein the fluid reservoir bottom opening is configured for filling and dispensing, whereby the fluid reservoir bottom opening provides a constant pressure for a filling chamber;

f. a first polarity base, wherein the first polarity base is electrically conductive that is either a positive base or a negative base, wherein the first polarity base has a first polarity base air intake that is either a positive base air intake or a negative base air intake;

g. a duckbill valve disposed within the first polarity base body through a base opening; wherein the duckbill valve has a duckbill valve sidewall that is flexible and allows air to be selectively passed through a duckbill valve opening, wherein the duckbill valve opening is formed on an end of the duckbill valve opposite a valve lower retaining ring, wherein the valve lower retaining ring fits to the base opening and deforms in an elastomeric manner so that it is lodged within the base opening; and h. a second polarity base, wherein the second polarity base is electrically conductive and insulated from the first polarity base body by an insulating sleeve, wherein the second polarity base is either a positive base or a negative base of opposite orientation to the first polarity base, wherein the second polarity base has a second polarity base air intake, that could be a positive base air intake or a negative base air intake, wherein the second polarity base air intake and the first polarity base air intake allow air to be received to the duckbill valve; and i. wherein the fluid reservoir has a twist opening.

18. The vapor generating electronic cigarette of claim 17, further comprising: a connector connecting to a metal tube, wherein coil spring fits over the metal tube, wherein a chamber cover has a chamber cover O-ring which seals it to a heating element base, wherein the heating element base receives a silicone ring insulating it electrically from a positive connector.

* * * * *